United States Patent [19]

Rigby

[11] Patent Number: 4,869,727

[45] Date of Patent: Sep. 26, 1989

[54] PRODUCTION OF HARDENED COAL AGGLOMERATES

[75] Inventor: Geoffrey R. Rigby, Charlestown, Australia

[73] Assignee: The Broken Hill Proprietary Company Limited, Victoria, Australia

[21] Appl. No.: 162,340

[22] PCT Filed: Apr. 23, 1987

[86] PCT No.: PCT/AU87/00111

§ 371 Date: Dec. 31, 1987

§ 102(e) Date: Dec. 31, 1987

[87] PCT Pub. No.: WO87/06498

PCT Pub. Date: Nov. 5, 1987

[30] Foreign Application Priority Data

Apr. 24, 1986 [AU] Australia ..... PH5620

[51] Int. Cl.[4] ..... C10L 5/16

[52] U.S. Cl. ..... 44/16 D; 208/426; 44/16 R; 44/24; 210/728

[58] Field of Search ..... 44/12, 23, 24, 16 D, 44/16 R, 16 B; 23/313 R; 210/728, 738; 208/426, 14

[56] References Cited

U.S. PATENT DOCUMENTS 4,126,426 11/1978 Verschuur ..... 44/23 X
4,248,697 2/1981 Halvorsen ..... 44/24 X
4,277,252 7/1981 Dudt ..... 210/727 X
4,302,211 11/1981 Verschuur ..... 44/24
4,311,488 1/1982 Verschuur ..... 44/24 X
4,355,999 10/1982 Masologites ..... 44/24
4,455,148 6/1984 Nagata et al. ..... 44/24 X
4,492,638 1/1985 Hiratsuka et al. ..... 23/313 R

*Primary Examiner*—Glenn Caldarola
*Attorney, Agent, or Firm*—Armstrong, Nikaido, Marmelstein, Kubovcik & Murray

[57] ABSTRACT

A system for the production of hardened coal agglomerates comprising a first pump (P1) for pumping a coal-water slurry and a predetermined quantity of oil or other suitable hydrophobic liquid into an agitated mixing tank (1), a second pump (P2) for pumping the coal-water slurry and partially formed agglomerates from the first mixing tank (1) into a pipeline loop (L1) which returns the slurry/agglomerates to the tank (1), a third pump (P3) for removing slurry/agglomerates from the first mixing tank (1) and transporting it to a second mixing tank (2), means for introducing further fresh coal-water slurry into the inlet of the third pump (P3) and/or into the second mixing tank (2), a fourth pump (P4) for withdrawing the slurry/agglomerates from the second mixing tank (2) and transporting the mixture through a second pipeline loop (L2) which discharges back into the second mixing tank (2), and a fifth pump (P5) for withdrawing the slurry/agglomerates from the second mixing tank (2) for a recovery of the agglomerates by means of a screen or the like.

17 Claims, 1 Drawing Sheet

PRODUCTION OF HARDENED COAL AGGLOMERATES

FIELD OF THE INVENTION

This invention relates to improvements in the production of coal agglomerates which are suited to long-term storage and/or transportation in the agglomerate form.

BACKGROUND OF THE INVENTION

The formation of coal agglomerates from aqueous slurries containing particulate coal and oil has been widely practiced for many years. Many agglomeration processes have been proposed requiring varying degrees of energy input and oil consumption. Most processes having acceptable energy input requirements and residence times produce relatively oily or sticky coal agglomerates which, while being suitable as a feed stock for the immediate production of a coal-oil mixture, have been found to be unsuitable for long-term storage or transportation due to their stickiness and/or poor physical strength.

Examples of prior art agglomeration processes may be found in U.S. Pat. Nos. 4355999 Masologites, 4302211 Verschun and Australian Patent 534563 (AU-B 54496/80) Dudt. In each of the above processes, long residence times and/or multiple agglomeration stages are required to achieve an acceptable coal agglomerate and even then such products are not necessarily suited to transportation in large bulk carriers of the type which would make transportation of such agglomerates economically viable. In the case of AU-B 54496/80, it will be noted that a four stage process of increasing energy input is required to produce an acceptable agglomerate. Although the agglomerates produced by this process would be acceptably dry (that is, not sticky), the agglomerates would be unlikely to be of sufficient quality to survive transportation without unacceptable production of fines during the transportation process.

It is also well known to reduce the oiliness or stickiness of particulate coal agglomerates by the evaporative de-oiling of such agglomerates. However, such processes have the obvious disadvantage of increasing the energy requirements of the production process since super heated steam must usually be produced to provide the necessary energy to cause evaporation of the oil coating the agglomerates.

SUMMARY OF THE INVENTION

It is an object of the present invention to provide an improved coal agglomeration method which results in the production of better quality agglomerates in shorter residence times.

The invention therefore provides a process for the production of coal agglomerates comprising agitating an aqueous slurry of coal particles in a first agitating means in the presence of a predetermined quantity of oil to form coal agglomerates, further agitating said agglomerates in the presence of further coal particle bearing slurry to improve the dryness and quality of the agglomerates, characterised by the step of transporting the slurry containing said agglomerates in a pipeline to further improve the strength properties of the agglomerates.

The agglomerates produced have been found to be well suited for long-term storage and/or transportation in bulk.

In a preferred form of the invention, the step of transporting the slurry containing the agglomerates in a pipeline follows each of the agitation stages and the transporting is preferably achieved in a pipeline loop.

The consolidation which occurs during formation and circulation of the agglomerate bearing slurry through the pipeline in combination with the two-step coal addition operation permits the production of storage agglomerates having a relatively dry surface. Agglomerates produced in this way show little tendency for sticking together or for attrition during handling operations. For these reasons, they are eminently suited for long-term storage and/or for transportation in bulk. The results achieved were not predictable and the inventors found the improvement in agglomerate quality by the circulation of the slurry in a pipeline quite surprising. The inventors are not yet aware of the physical reasons for the unexpected improvements achieved by the pipeline circulation, but it is clear that the further contact between the agglomerates and the coal particles in the slurry which occurs in the pipeline is most beneficial.

In one preferred form of the present invention, the coal particles contained in the initial slurry are preferably coated with oil and formed into small agglomerates by introducing the slurry and the coating oil into the inlet of a turbulent flow slurry pump. This method of oil coating and formation of small agglomerates has been described in our Australian Patent No. 529242 (AU-B 56053/80). Of course it will by appreciated that acceptable results may be obtained by the simple addition of oil to the initial agitation stage in accordance with standard practice. However, the use of a turbulent flow slurry pump to achieve the initial oil coating and formation of small agglomerates has the advantage of reducing the energy requirements of the agglomeration process.

In the present specification the term "pipeline" should be construed as a pipe of substantial length, for example, at least 500 m. Similarly, the term "oil" should be construed to include all suitable hydrophobic liquids such as kerosene, diesel oil, fuel, oil, petroleum residue and heavy aromatic materials such as coke oven tars and bitumen and suitable mixtures thereof.

BRIEF DESCRIPTION OF THE DRAWINGS

A preferred embodiment of the invention will now be described with reference to the accompanying drawing in which.

DESCRIPTION OF PREFERRED EMBODIMENT

Figure 1:
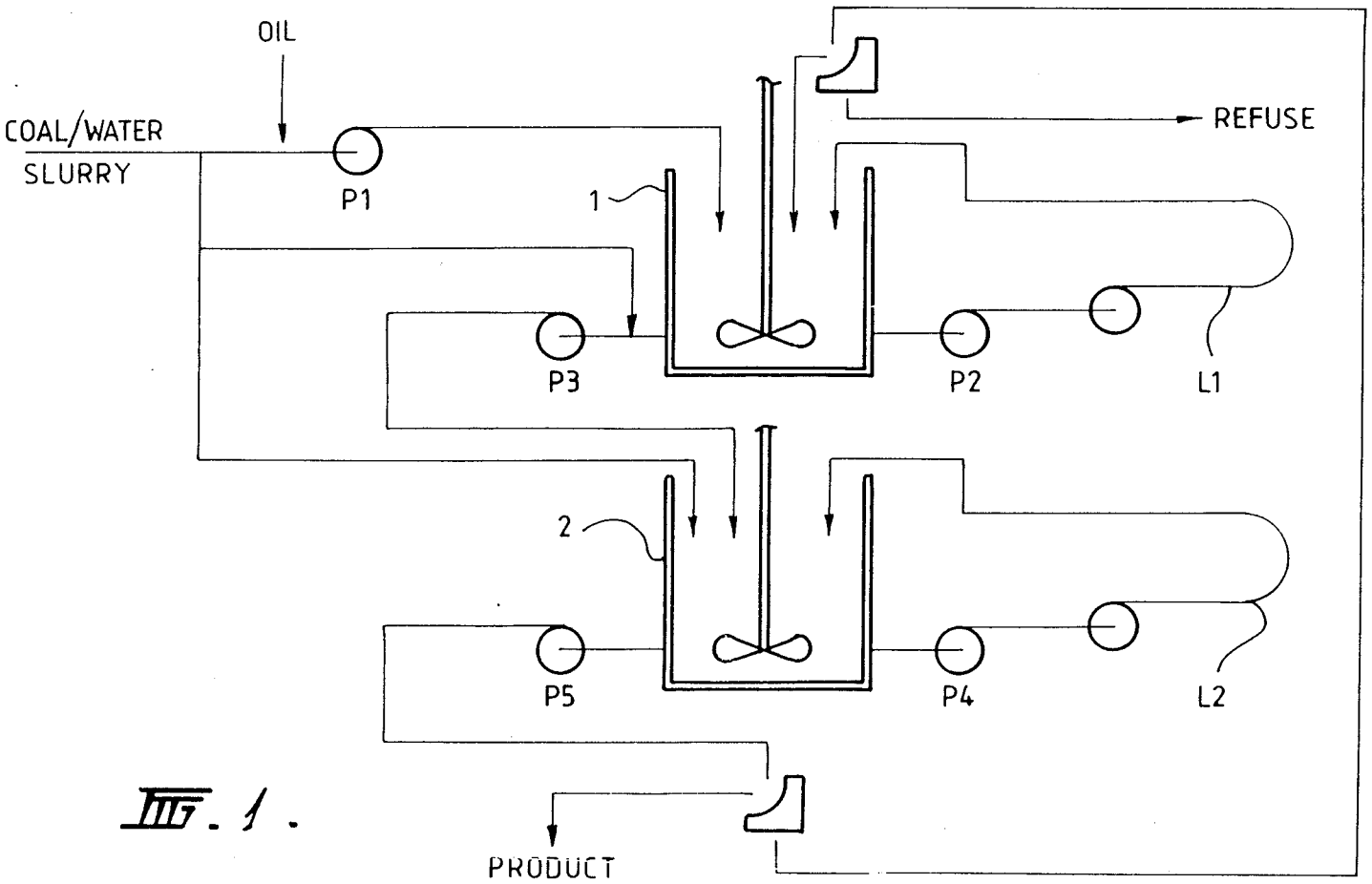
FIG. 1 is a schematic diagram showing an arrangement for performing the process according to a preferred embodiment of the invention.

Referring to FIG. 1 of the drawings, the arrangement shown for performing the preferred embodiment of the process according to the invention comprises a turbulent flow slurry pump P1 into the inlet of which suitable oil and a particulate coal bearing aqueous slurry is introduced in the manner described in greater detail in our Australian Patent No. 529242. While it may be convenient to inject the oil directly into the inlet of the pump, it will be appreciated that the oil may be added at any suitable position upstream of the pump inlet.

The slurry generally contains 30–50% by weight of solids, including particulate coal which may result from a grinding operation, washery or tailing pond. Any suitable oil, such as a suitable grade of fuel oil, may be used to achieve agglomeration and the quantity of oil introduced into the inlet of the pump P1 is selected according to the nature of the particulate coal contained in the slurry (see above Patent No. 529242).

The pump P1 discharges into a first agitation tank 1 in which the oil coated coal and partially formed agglomerates produced in the pump P1 are further agglomerated. A second pump P2 is connected to the tank 1 and recirculates the agglomerate bearing slurry produced in the tank 1 through a pipeline loop L1 back into the agitation tank 1. During its passage through the pipeline loop L1, the agglomerates are consolidated to increase their strength and the strengthened agglomerates are recycled into the mixing tank 1 so that further growth can occur by contact with fresh oil coated coal particles. The length of the pipe loop L1 is selected in conjunction with other operating parameters (such as oil addition level, particle size distribution, residence time in the tank/pipe loop) to achieve the required consolidation and is preferably longer than 500 meters; for example 1600 m has been used in some pilot plant trials. It has been surprisingly found that the consolidation which occurs in the pipe loop L1 in combination with the agitated tank 1, is not readily achieved in the agitated tank 1 alone, certainly not in the same overall residence time. In addition, the size of the agglomerates can be controlled by adjustment of pipeline velocity and combined residence time in the tank 1 and pipe loop L1.

If desired the pipeline may include flow disturbing means which increase the mixing of the slurry in the pipeline as it is transported therethrough. See for example our Australian Patent No. 529242 or U.S. Pat. No. 3856668.

In an experimental pilot plant constructed to test the viability of the process according to the present invention, the following parameters have been found to be successful:

An agitated tank having a volume of 300 $m^3$ has been used in conjunction with a 100 mm diameter pipe loop. The agitator is fitted with a 21 kW motor. The total length of the pipe loop was 1600 m with bypasses fitted to allow use of 400 m, 800 m or 1600 m lengths.

When using the 1600 m length it was found necessary to use more than one pipe loop pump to provide the necessary head. Three 3/2 high head Warman slurry pumps were installed for this purpose.

Various combinations of pipe loop length and combined pipe loop-agitated tank residence times have been used to successfully produce the desired agglomerates depending on the nature of the feed slurry.

A typical set of conditions include a combined mean residence time of three hours using a pipe loop length of 800 m.

When processing small batches of material, (say 2-3 tonnes) a smaller agitated tank having a volume of approximately 2 $m^3$ may be used in conjunction with the pipe loop.

A third pump P3 continuously transfers agglomerate bearing slurry from the tank 1 to a further tank 2 to which fresh particulate coal bearing slurry is added. The second mixing tank 2 operates in a similar manner to the first mixing tank 1 and a fourth pump P4 circulates agglomerate bearing slurry from the tank through a second pipeloop L2 and back into the tank 2 to further improve the strength of the agglomerates. The addition of fresh slurry to the tank 2 improves the surface condition of the agglomerates reducing their oiliness while the second pipeloop L2 consolidates the agglomerates produced in the tank 2 and improves their strength.

A fifth pump P5 transfers the agglomerated product from the tank 2 to a dewatering/classifying screen from which any small undersize agglomerates are returned to the tank 1 after separation of the waste mineral matter and water.

In a modification of the above embodiment, the second mixing tank 2 is eliminated and the agglomerate bearing slurry from the first mixing tank 1 is pumped directly into the second pipe loop L2 for further conditioning in the presence of fresh particulate coal bearing slurry, which may be introduced into the inlet of pump P4 in any suitable manner.

A batch of approximately 2.2 tonnes of agglomerates has been produced using a pilot plant according to the preferred embodiment described above and the batch subjected to flowability tests.

In the pilot plant, the coal was processed through a hammer mill and ball mill to generate a size distribution similar to a typical pulverized fuel specification. The fuel oil used to achieve agglomeration was heated to a temperature of 30°-35° C. before addition to the slurry and the slurry was circulated through the pipe loop L1 for several hours prior to the oil addition to increase the temperature of the slurry to approximately 25° C. The remainder of the process was as described above and the resultant de-watered agglomerates were found to be strong and well formed with a top size of 2.3 mm.

The following Table 1 summarises the results for this run (d.b.=dry basis).

TABLE 1

Summary of Results for Agglomerates Produced by the Pilot Plant

| | |
|---|---|
| Feed Coal | |
| Ash % d.b | 20.1 |
| Size analysis prior to agglomeration | |
| Agglomerated Product | |
| Size, mm | (% passing) |
| 0.5 | 98.8 |
| 0.25 | 96.0 |
| 0.125 | 83.7 |
| 0.063 | 61.0 |
| Fuel oil addition | |
| (% by weight dry feed coal) | 16.7 |
| Ash, % d.b | 6.9 |

It may be concluded from the tests conducted to date (as detailed further below) that the method of the invention produces agglomerates which are stronger, less sticky and have a lower (2%-3%) ash level than agglomerates produced by the prior art methods. While detailed comparative tests have not been conducted, qualitative observations have indicated that the prior art methods would not be capable of producing an agglomerate product of the same quality without unacceptable residence times in stirred tanks. The relatively short term circulation of the partly formed agglomerates in the presence of fresh slurry causes additive consolidation and further release of mineral matter, to a greater extent than would be achieved by further stirred tank processing for an equivalent time. It is not clear why pipeline circulation achieves these results although it is clear that the agitation which occurs in a pipeline is different in character to stirred tank agitation.

The batch of agglomerates produced by the pilot plant was subjected to testing to determine the flow properties of the agglomerates and their ability to withstand transportation in bulk.

For the design and performance evaluation of material handling facilities, it is necessary to examine samples of the materials which are likely to produce the most difficult flow conditions. The conditions of moisture content, temperature and storage time relevant to the material under actual operating conditions need to be duplicated in the test. However, since the main aim of the tests is to obtain the characteristics of the agglomerates for preliminary assessment of handling characteristics of the agglomerate, particularly under sea transportation conditions, oiled agglomerates having a moisture level equivalent to that expected from a stock pile of the material were tested.

Table 2 lists the properties of the oiled agglomerates used in the tests (d.b.=dry basis a.d.b.=air dry basis).

TABLE 2

| Properties of Oiled Agglomerates | |
|---|---|
| Moisture % (a.d.b.) | approximately 5 |
| Oil % (d.b.) | approximately 17 |
| Ash % (d.b.) | approximately 6.9 |
| Size Analysis: | |
| Size, mm | % Passing |
| 2.0 | 68 |
| 1.0 | 4 |
| 0.5 | 0.5 |

AGGLOMERATE HANDLING CHARACTERISTICS

The ability of a bulk material to flow is dependent on the strength developed by the material due to consolidation and weathering. As a result of this strength, the material may be able to form a stable arch or pipe. Free flowing bulk materials have no cohesion and hence no strength.

Tests have indicated that agglomerates manufactured in accordance with the present invention, and at 5% moisture level, behave essentially as a free flowing material. Although this free flow characteristic is slightly different from a perfectly free flowing material such as dry sand whose unconfined yield strength is always zero, energy coal showed much greater strength than that of the agglomerates. This means that the flowability of the agglomerates is much better than that of typical Australian export coals.

Although there is some breakage of the agglomerates under high stress conditions, tests have also shown that the handling characteristics of the agglomerates are satisfactory for ship loading transportation and unloading, and for hopper storage.

SHIP TRANSPORTATION TESTS

Degradation of particles due to stress and to vibration of the ship is not a serious problem for the majority of bulk solids as the particles are intrinsically strong. However consolidation (or compaction) of the bulk solids can create serious material handling problems if the bulk solids contain a large proportion of fines or the bulk solids have a cohesive characteristic.

The difficulty in handling compacted bulk solids is dependent on the degree of strength developed in the compacted material and this important characteristic depends on the proportion of fines, moisture content, consolidation pressure, storage time and in the case of oiled agglomerates the oil content.

Tests have been conducted to evaluate the effect of stress on the compaction and degradation of our oiled agglomerates to predict the degree of degradation and compaction of the agglomerates which could be expected in the cargo hold of a 100,000 DWT bulk carrier. These tests have shown:

(1) During loading into the cargo hold of a ship, agglomerates are compacted, by the weight of the material during loading, but further compaction due to storage time and ship vibration is small.

(2) At a stress above 100 kPa the agglomerates formed into a consolidated cake although blocks of the cake were easily broken into separate agglomerates. This means that the compacted agglomerates near the bottom of the ship hold would not come crumbling down easily when the agglomerates are unloaded. However this is not essential if the material is unloaded using a grab.

(3) At a stress of 150 kPa (estimated stress for a material depth of 20 m in the cargo hold) the degradation of agglomerates would be expected to result in an increase in the 0.5 mm size particles of about 5%. At the half depth of the hold (10 m deep) the figure would be less than 1%. These fines do not appear as discrete dry particles but are attached to the surrounding larger particles of agglomerates. Hence they do not form a dust problem in handling.

FURTHER EXAMPLE OF THE INVENTION

To check the viability of the process embodying the invention for lower grade feed material, further tests were conducted using the pilot plant described above and are detailed below.

Five tankers containing a waste thickener underflow from a high volatile energy coal preparation plant were transported to the pilot plant for testing.

Following transfer of the slurry to a surge tank, the solids concentration was adjusted to approximately 20% (by weight) prior to desliming.

Desliming was undertaken by pumping the slurry through two 100 mm KRT 2118 IV cyclones. An initial test was done using a 20 mm apex stopper diameter. However this was subsequently enlarged to 25 mm diameter to give a cyclone underflow solids concentration of approximately 40%. A cyclone inlet pressure of 250 kPa was used and the flowrate to each cyclone was approximately was 17 $m^3/h$. The underflow was stored in temporary tanks during processing and returned to the surge tank on completion of the desliming. Some additional water was used to rinse the large particles from these tanks.

The desliming slurry was circulated through a ball mill closed circuit to grind the solids to a size distribution close to that of typical pulverised coal (99% passing 300 microns). Approximately 10 $m^3$ of this slurry was reserved for secondary addition to the agglomerates after initial agglomeration.

After grinding, agglomerating oil was added to the slurry at the inlet to the ball mill sump pump whilst the slurry was circulated through a 1 km long 100 mm diameter pipeloop and surge tank circuit. The oil was added in several steps to ensure that excessive oil was not used.

A low sulphur furnace oil (0.4% sulphur) was used to permit the production of agglomerates having a low sulphur specification.

Circulation of the slurry was continued until the agglomerates had reached 2–3 mm in diameter. At this stage additional finely ground slurry was added to the surge tank to absorb excessive oil on the agglomerate surface and produce a "non sticky" transportable product. Circulation was continued for a further two hours prior to dewatering the agglomerates on a 0.5 mm wedge wire vibrating screen.

A series of water sprays were used on the screen to rinse off excessive clays and other mineral matter prior to discharge of the agglomerates into the storage hopper.

Details of the various slurry and solids balances are summarised below. These figures are approximate and are based on best estimates from tank volumes and flows. Note that there are some variations in volumes due to additional water used for rinsing the pump gland seals.

| Thickener Underflow | | |
|---|---|---|
| | total volume = | 104 $m^3$ |
| | solids = | 35 t |
| after unloading to surge tank | total volume = | 154 $m^3$ |
| | slurry density = | 1.108 $t/m^3$ |
| | solids concentration = | 20.6% |
| | solids = | 35 t |

| Size analysis and Ash distribution | | |
|---|---|---|
| Size fraction mm | Weight Fraction % | Ash % d.b. |
| +0.5 | 3.9 | 22.6 |
| −0.5 +0.25 | 15.8 | 31.6 |
| −0.25 +0.125 | 16.0 | 47.7 |
| −0.125 +0.063 | 12.0 | 37.5 |
| −0.063 | 52.3 | 58.9 |
| total | | 48.8 |

| Cyclone Underflow | |
|---|---|
| total volume = | 47 $m^3$ |
| slurry density = | 1.199 $t/m^3$ |
| solids concentration = | 40.5% |
| solids = | 23 t |
| solids recovery yield from cyclone fee, d.b. = | 65.7% |
| *coal matter recovery from cyclone feed. d.b. = | 72.8% |

| Size analysis and Ash distribution | | |
|---|---|---|
| Size fraction mm | Weight Fraction | Ash % d.b. |
| +0.5 | 7.0 | 21.7 |
| −0.5 +0.25 | 22.3 | 29.5 |
| −0.25 +0.125 | 22.3 | 40.3 |
| −0.125 +0.063 | 16.2 | 33.4 |
| −0.063 | 32.2 | 67.8 |
| Total | | 44.3 |

| Cyclone Overflow | |
|---|---|
| total volume = | 122 $m^3$ |
| slurry density = | 1.048 $t/m^3$ |
| solids concentration = | 9.55% |
| solids = | 12 t |

| Size analysis and Ash distribution | | |
|---|---|---|
| Size fraction mm | Weight Fraction % | Ash % d.b. |
| +0.063 | 2.2 | 11.1 |
| −0.063 +0.045 | 1.6 | 6.1 |
| −0.045 +0.038 | 1.6 | 8.2 |
| −0.038 | 94.6 | 58.7 |
| Total | | 56.0 |

| Crushed Slurry Prior to Agglomeration | |
|---|---|
| total volume = | 71 $m^3$ |
| slurry density = | 1.136 $t/m^3$ |
| solids concentration = | 28.8% |
| solids = | 23 t |

| Size Analysis | |
|---|---|
| Size, mm | % passing |
| 0.5 | 99.9 |
| 0.25 | 99.3 |
| 0.125 | 94.3 |
| 0.063 | 75.1 |
| Ash. % d.b. = 44.3 | |

-continued

| Agglomeration | |
|---|---|
| volume of initial slurry used for agglomeration = | 61 $m^3$ |
| solids = | 20 t |
| total oil added = | 3666 kg (assuming oil density = 0.94 $t/m^3$) |
| oil added on initial solids (d.b.) = | 18.3% (by weight) |
| Additional solids added = during secondary agglomeration | 3.3 t |
| oil added on total = solids (d.b.) | 15.7% |

| Product Agglomerates | |
|---|---|
| Estimated agglomerated = product, dry, oil free | 12.2 t |
| Estimated agglomerated = product including oil and 10% moisture | 17 t |
| Product ash, % dry oil free = | 5.9 |
| Estimated product yield = from ground deslimed slurry, % d.b. (for tailings ash = 86.5% d.b.) | 52.2 |
| Estimated product yield = from original thickener underflow, % d.b. | 34.9 |
| Estimated coal matter yield = from ground slurry, % d.b. | 97 |
| Estimated coal matter yield = from original thickener underflow, % d.b. | 70.6 |
| Estimated oil based on = dewatered product basis (including oil and 10% moisture) | 21.6% |

| Chemical Analysis: (expressed on moisture free basis, including oil) | |
|---|---|
| Ash | 5.0% |
| Volatile Matter | 46.8% |
| Fixed Carbon | 48.2% |
| Total Sulphur | 0.42% |
| Specific Energy | 33.9 MJ/kg |

*coal matter = solids − mineral matter; assuming mineral matter = 1.1 × ash.

The moisture of the agglomerates from the product hopper after overnight drainage was approximately 12.5%.

Agglomeration and mineral matter separation of the deslimed product was readily achieved in the above example.

The product ash was significantly lower than that achieved in bench scale tests using conventional stirred agglomeration techniques; this results from the higher levels of consolidation and exclusion of mineral matter achieved in the pipeline and agitated tank circulation system. Petrographic examination of bench scale products showed that the mineral matter in those agglomerates contained approximately 25% pyrite. It is presumed that use of the present invention results in elimination of the majority of this pyrite, as long as it is ground to a size which allows separation over the dewatering screen.

The claims defining the invention are as follows:

1. A process for production of coal agglomerates comprising agitating an aqueous slurry of coal particles in a first agitating zone in the presence of oil to form coal agglomerates, further agitating said agglomerates in either the first agitating zone or a second agitating zone in the presence of a fresh coal particle bearing slurry to improve the dryness and quality of the agglomerates, characterized by the step of transporting the slurry containing said agglomerates in a pipeline having a length of 500 m or longer and being in communication with either the first agitating zone or the second agitating zone to further improve the strength properties of the agglomerates.

2. The process of claim 1, wherein the step of transporting the slurry in a pipeline follows the firstmentioned agitation stage.

3. The process of claim 1 or 2, further comprising the step of introducing further coal bearing aqueous slurry to the slurry being transported in said pipeline.

4. The process of claim 3 wherein said step of transporting the slurry comprises recirculation in a pipeline loop back to the first agitating zone.

5. The process of claim 2, further comprising delivering said slurry containing said agglomerates from said pipeline to a second agitating zone and agitating said agglomerates in the presence of fresh coal bearing slurry.

6. The process of claim 5, further comprising transporting the agglomerates and slurry from said second agitating zone through a further pipeline to further improve the quality of said agglomerates.

7. The process of claim 6 wherein said transportation of agglomerates and slurry from the second agitating zone comprises recirculation in a pipeline loop back to the second agitating zone.

8. An apparatus for producing coal agglomerates comprising a first agitation means, means for introducing an aqueous slurry of coal particles into said first agitating means in the presence of oil, means for withdrawing the slurry and agglomerates produced by said first agitating means, a first pipeline having a length of 500 m or longer and being connected to said withdrawing means, and means for collecting said agglomerates from said pipeline for further processing.

9. The apparatus of claim 8, further comprising a second agitating means, means for introducing said agglomerates from said first pipeline into said second agitating means, means for introducing fresh coal bearing aqueous slurry into said second agitating means, a second pipeline having a length of 500 m or longer and being attached to said second agitating means and means for circulating said agglomerate bearing slurry through said second pipeline.

10. The apparatus of claim 8, further comprising means for introducing fresh coal bearing aqueous slurry into said pipeline.

11. The process of claim 7, further comprising the step of transferring the agglomerated product of the second agglomeration zone to a dewatering/classifying screen, and wherein said transportation of the slurry from the first agitation zone comprises recirculation of the slurry in a pipeline loop back to the first agitation zone.

12. The apparatus of claim 9, further comprising a means for transferring the agglomerated product of the second agglomeration means to a dewatering/classifying screen, wherein the first pipeline comprises a pipeline loop which returns to the first agitation means, and wherein the second pipeline comprises a pipeline loop which returns to the second agitation means.

13. The apparatus of claim 8 wherein the first pipeline comprises a pipeline loop which returns to the first agitation means.

14. The apparatus of claim 9 wherein the second pipeline comprises a pipeline loop which returns to the second agitation means.

15. In a process for production of coal agglomerates comprising agitating an aqueous slurry of coal particles in at least one agitating zone in the presence of a predetermined quantity of oil to form coal agglomerates, further agitating said agglomerates in at least one agitating zone in the presence of further coal particle bearing slurry to improve the dryness and quality of the agglomerates, the improvement comprising improving the strength properties of the agglomerates by transporting the slurry containing said agglomerates in a pipeline having a length of 500 m or longer and said pipeline being a communication with at least one agitating zone.

16. The process of claim 15 wherein said agitating of the aqueous slurry and said further agitating the agglomerates occur in the same agitating zone.

17. The process of claim 15 wherein said agitating of the aqueous slurry and said further agitating the agglomerates occur in a different agitating zone.

* * * * *